US007861475B2

(12) United States Patent
Sprague

(10) Patent No.: US 7,861,475 B2
(45) Date of Patent: Jan. 4, 2011

(54) WALL PANEL SYSTEM INCLUDING A PIVOT LOCK

(75) Inventor: Gary Sprague, Los Angeles, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 419 days.

(21) Appl. No.: 12/056,093

(22) Filed: Mar. 26, 2008

(65) Prior Publication Data

US 2009/0241493 A1 Oct. 1, 2009

(51) Int. Cl.
*E05D 15/22* (2006.01)
*E05D 15/58* (2006.01)

(52) U.S. Cl. ..... 52/243.1; 52/64; 49/127; 49/177; 49/183; 49/409; 49/449; 160/196.1; 160/200; 292/163; 292/169

(58) Field of Classification Search ..... 52/64, 52/243.1; 49/127, 177, 183, 409, 449; 160/196.1, 160/200; 109/70; 70/100; 292/163, 169
See application file for complete search history.

(56) References Cited

U.S. PATENT DOCUMENTS

| | | | | | |
|---|---|---|---|---|---|
| 426,765 | A * | 4/1890 | Brunhoff et al. | ..... | 292/166 |
| 1,085,065 | A * | 1/1914 | Speicher | ..... | 49/177 |
| 1,294,949 | A * | 2/1919 | Roberts | ..... | 70/120 |
| 1,335,192 | A * | 3/1920 | Raley et al. | ..... | 292/37 |
| 1,571,194 | A * | 2/1926 | Frantz | ..... | 160/199 |
| 2,202,916 | A * | 6/1940 | Mussa | ..... | 292/177 |
| 3,195,192 | A * | 7/1965 | Neisewander | ..... | 49/127 |
| 5,031,274 | A * | 7/1991 | Eutebach | ..... | 16/229 |
| 5,394,648 | A * | 3/1995 | Kordes | ..... | 49/177 |
| 2009/0241445 | A1 * | 10/2009 | Sprague | ..... | 52/243.1 |

* cited by examiner

*Primary Examiner*—Robert J Canfield
(74) *Attorney, Agent, or Firm*—Mitchell P. Brook; Luce Forward, Hamilton & Scripps LLP

(57) ABSTRACT

A wall panel system includes a sliding wall panel assembly that includes a pivot lock for converting the wall panel assembly between a sliding configuration and a pivoting configuration. The pivot lock includes a first lock member that is configured to selectively prevent translation of the wall panel assembly along a track and a second lock member that is configured to selectively prevent pivoting of at least a portion of the wall panel assembly relative to the track.

20 Claims, 8 Drawing Sheets

WALL PANEL SYSTEM INCLUDING A PIVOT LOCK

FIELD OF THE INVENTION

The present invention relates to movable wall panel systems and, in particular, to wall panel systems that include pivoting wall panel assemblies.

BACKGROUND OF THE INVENTION

Movable wall panels are often used to divide an area into two or more regions. For example, movable wall panels are employed in schools, hotels, and convention centers to divide a large room into two or more smaller rooms. Another common use of movable wall panels is the formation of individual shop fronts within a mall. Clear glass panels are typically stored during business hours to produce a wide-open storefront, and are disposed in front of the storefront during off-business hours while permitting the viewing of merchandise. Alternatively, the clear glass panels may be disposed in front of the storefront during business hours if desired, and a single panel may be configured to pivot to provide access, for example during inclement weather.

Movable wall panel systems typically include several components, such as wall panels, trolleys coupled to the wall panels, and tracks within which the trolleys can slide to displace the wall panels. The wall panels often are large planar structures that may be separate or attached to one another end-to-end. Many modern applications of wall panel systems utilize separate wall panels in order to allow greater versatility than systems employing wall panels that are attached end-to-end.

Mechanisms may be included that allow a sliding panel to be converted into a pivoting panel. For example, U.S. Pat. No. 5,394,648 to Kordes discloses a door or wall partition panel that includes a unit for swinging and sliding the panel. The panel is pivotally coupled to a movable carrier that is suspended from a rail by a plurality of suspensions. A floor lock is included on a lower portion of the panel that provides for selectively locking and unlocking the door to at a specific location. The floor lock also provides a hinging function for the swinging movement of the door when it is in the locked position. A fixing and locking unit is also included on the upper portion of the panel that is configured to selectively lock relative motion between the rail and the carrier and between the panel and the carrier. The fixing and locking unit includes two independent lock mechanisms, one that selectively prevents translation of the panel along the rail and another that selectively prevents pivoting motion of the panel relative to the carrier. The independence of the lock mechanisms provides a significant disadvantage for the fixing and locking unit because a user is required to employ the proper sequence of locking and unlocking the unit in order to avoid damaging the panel.

Another example of a mechanism that allows a sliding panel to be converted into a pivoting panel is disclosed in U.S. Pat. No. 1,085,065 to Speicher. The sliding panel is supported from a carrier that is movable on a track by hangers that extend between the carrier and a supporting bar. The supporting bar is coupled to the door by a hinge connection adjacent a first end and a pin adjacent a second end. A retractable latch mechanism extends between the door and the carrier that may be used to lock the carrier relative to a doorjam so that it is prevented from sliding. The latch mechanism includes mating coupling members that allow a portion of the latch mechanism coupled to the door to be disengaged from a portion coupled to the carrier. Disengagement of those portions along with removal of the pin allows the door to be pivoted relative to the supporting bar about the hinge connection.

A significant disadvantage of the known lock mechanisms is that they require multiple operations that must be performed by a user in proper order to operate correctly and to avoid damaging the wall panel.

Accordingly, there is a need for a lock mechanism that requires a user to perform a single step to properly operate the mechanism.

SUMMARY OF THE INVENTION

The present invention alleviates to a great extent the disadvantages of known door lock systems by providing a pivot lock and related method of use, in which the pivot lock allows a user to convert a wall panel assembly between a sliding configuration and a pivoting configuration by a simple operation. The pivot lock mechanism includes a first lock member and a second lock member that are coupled by a coupling mechanism. The coupling mechanism is adapted to create concerted motion of the first and second lock member.

A pivot lock mechanism for a wall panel system including a pivoting wall panel including a sliding portion that is translatable along a track and a pivoting portion that pivots relative to the sliding portion is provided. The pivot lock includes a first lock member, a second lock member and a coupling mechanism. The first lock member is movable between an extended position in which it extends between the sliding portion and the track to prevent relative motion therebetween, and a retracted position in which it is positioned to permit relative motion between the sliding portion and the track. The second lock member is movable between an extended position in which it extends between the sliding portion and the pivoting portion to prevent relative motion therebetween, and a retracted position in which it is positioned to permit relative motion between the sliding portion and the pivoting portion. The coupling mechanism extends between the first and second lock members and couples the first and second lock members. The coupling mechanism is configured to create concerted motion between the lock members so that when the first lock member is in the extended position the second lock member is in the retracted position, and when the first lock member is in the retracted position the second lock member is in the extended position.

In an embodiment, the lock members are engagement pins that selectively extend from and retract into a plurality of housings. In further embodiments, the lock members may be configured to slidably and/or threadably engage bores included in the housings. A biasing mechanism may be provided that urges the lock members into a predetermined position. In an embodiment, a biasing spring urges the first lock member into an extended position.

In another embodiment, a wall panel system is provided. The wall panel system includes a track and a wall panel assembly. The wall panel assembly includes a sliding portion slidably coupled to the track, and further includes an upper rail, a lower rail and a wall panel fixedly coupled to each of the upper rail and the lower rail and interposed therebetween. The pivoting wall panel assembly is translatably coupled to the track, and includes a slide rail, a pivot rail, a wall panel, a lower rail, a door closer assembly, a spindle and a linear actuator. The pivot rail is pivotally coupled to the slide rail, and the wall panel is fixedly coupled to the pivot rail. The lower rail is coupled to a second side of the wall panel opposite the pivot rail. The retractable floor anchor is coupled to the lower rail and includes a base member, a door closer assembly, a spindle and a linear actuator. The spindle is rotatably coupled to the door closer assembly. The linear actuator moveably couples the base member to the spindle and is adapted to translate spindle relative to the base member along a vertical axis between a retracted position and an extended position. The spindle is spaced further from the base member in the extended position than in the retracted position.

The wall panel system further includes a pivoting portion pivotally coupled to the sliding portion, and a pivot lock. The pivot lock includes a first lock member, a second lock member and a coupling mechanism extending between the first and second lock members. The first lock member is movable between an extended position in which the first lock member extends between the sliding portion and the track and prevents relative motion therebetween, and a retracted position in which the first lock member is positioned to permit relative motion between the sliding portion and the track. The second lock member is movable between an extended position in which the second lock member extends between the sliding portion and the pivoting portion and prevents relative motion therebetween, and a retracted position in which the second lock member is positioned to permit relative motion between the sliding portion and the pivoting portion. The coupling mechanism couples the first and second lock members so that when the first lock member is in the extended position the second lock member is in the retracted position, and when the first lock member is in the retracted position the second lock member is in the extended position.

These and other features and advantages of the present invention will be recognized from a review of the following detailed description of the invention, along with the accompanying figures in which like reference numerals refer to like parts throughout.

DETAILED DESCRIPTION OF THE INVENTION

In the following paragraphs, the present invention will be described in detail by way of example with reference to the accompanying drawings. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Figure 1:
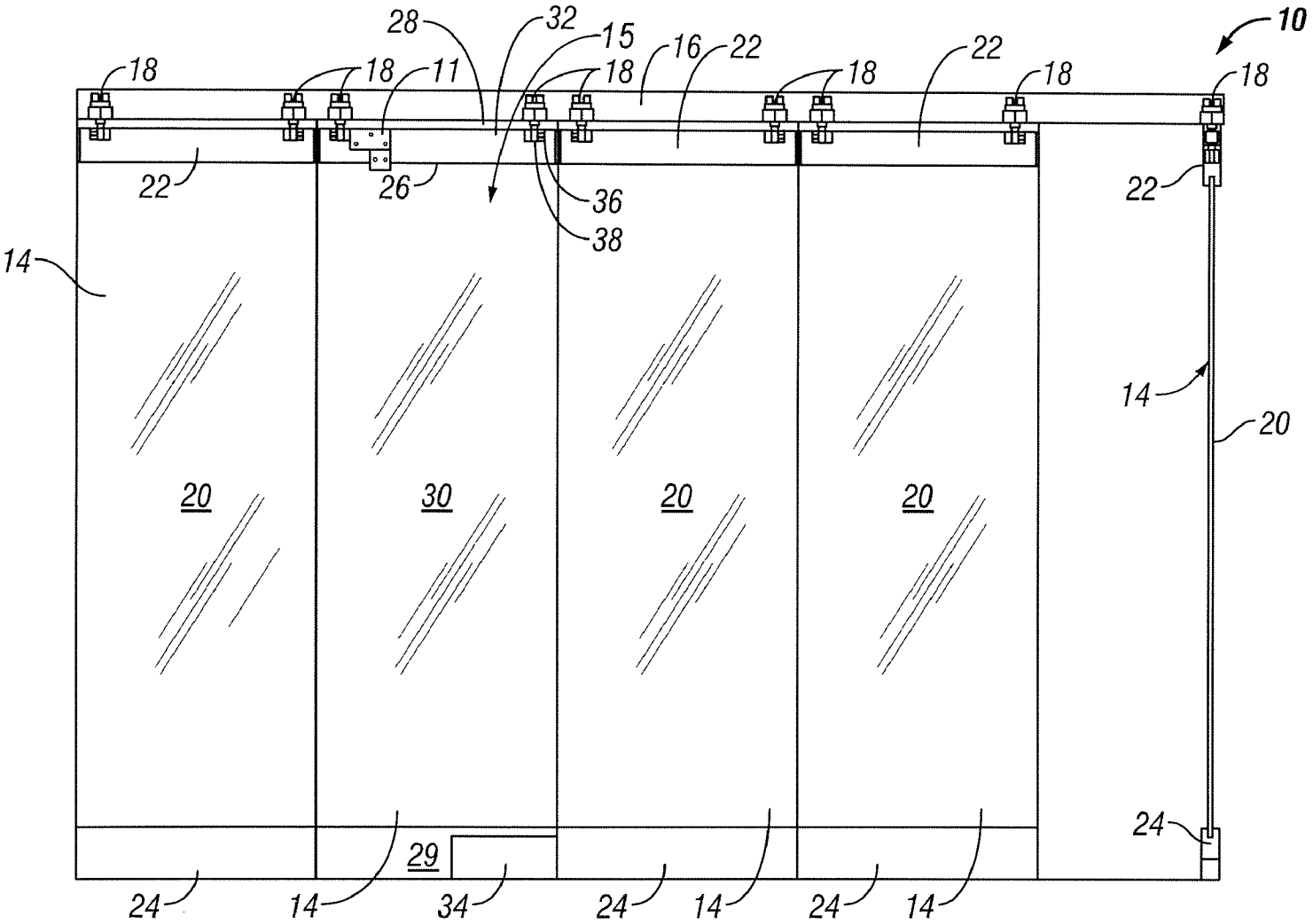
FIG. 1 is a side view of an exemplary embodiment of a wall panel system incorporating a pivot lock mechanism in a sliding configuration.
Figure 2:
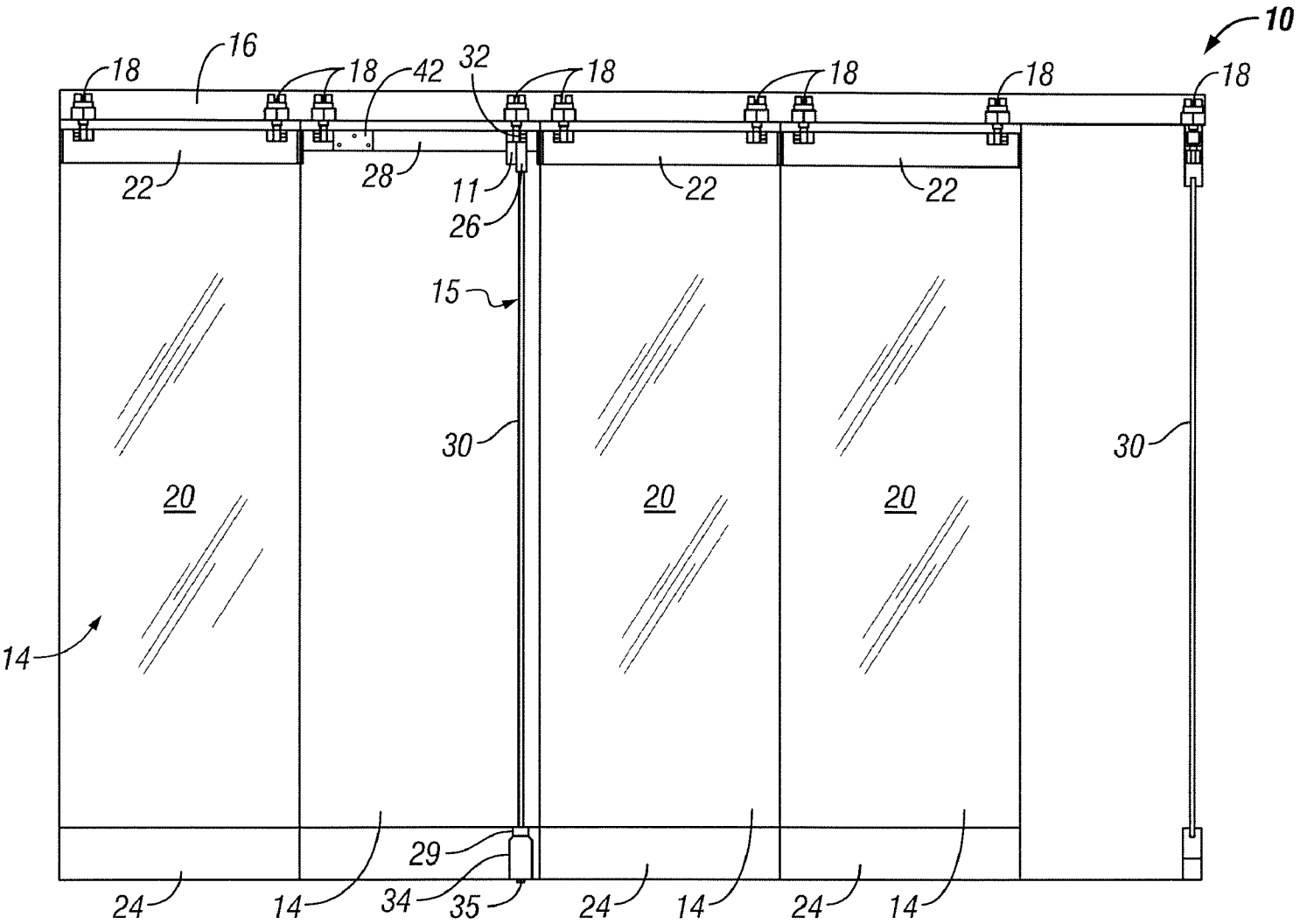
FIG. 2 is another side view of the wall panel system of FIG. 1 with the pivot lock mechanism in a pivoting configuration.
Figure 3:
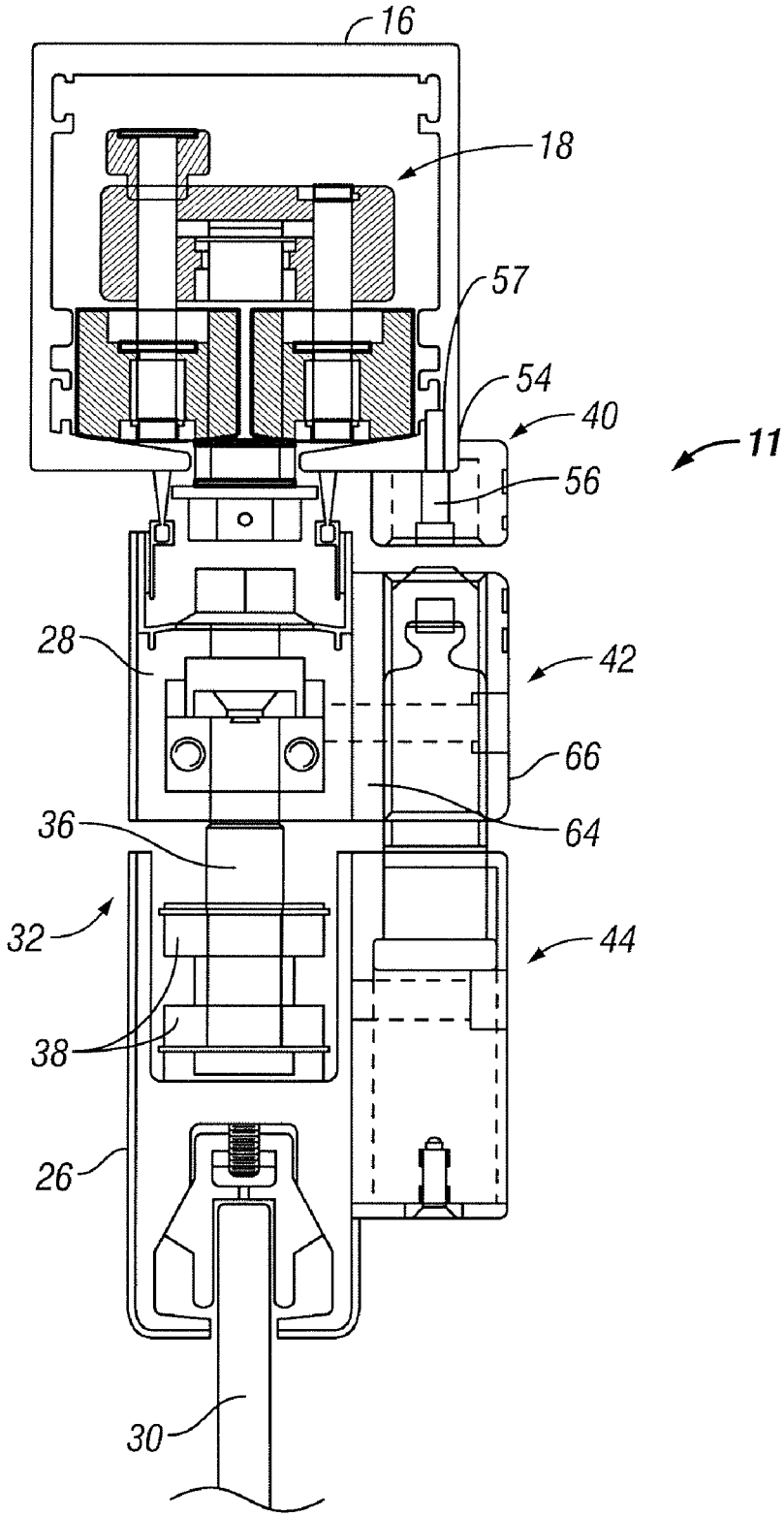
FIG. 3 is a partial cross-sectional view of a portion of a wall panel assembly including a pivot lock mechanism.

Referring first to FIGS. 1-3, a wall panel system 10 is described in which a pivot lock mechanism 11 is utilized. In general, pivot lock mechanism 11 allows a pivoting wall panel assembly 15 of wall panel system 10 to be converted between a sliding/rolling configuration and a pivoting configuration. In particular, pivot lock mechanism 11 includes a first lock member that selectively locks a sliding interface between wall panel assembly 15 and track 16 and a second lock member that selectively locks a pivoting interface between portions of wall panel assembly 15. The first and second lock members of pivot lock 11 are coupled so that operation of one results in concerted operation of the other and as a result, a user is only required to perform a single operation to properly operate the pivot lock.

In an embodiment, pivot lock mechanism 11 includes a pair of coupled engagement pins, i.e., lock members, one of which extends between a sliding portion and a pivoting portion of wall panel assembly 15 and the second extends between the sliding portion of wall panel assembly 15 and track 16. It will be appreciated that the term "sliding portion" is used herein to refer to a portion of wall panel assembly 15 that only slides relative to track 16. Additionally, the term "pivoting portion" is used herein to refer to a portion of wall panel assembly 15 that slides relative to track 16 and pivots relative to both track 16 and the slide portion. Unlike previous pivot lock mechanisms, pivot lock 11 is adapted so that a single control interface is used to operate the mechanism and to assure that a plurality of lock members are extended and/or retracted in a predefined order. Such a configuration simplifies the use of the pivot lock mechanism and prevents damage to the wall panel that may be caused by extending and/or retracting the pins in the incorrect order.

Wall panel system 10 includes a plurality of separate wall panel assemblies, including sliding wall panel assemblies 14 and at least one pivoting wall panel assembly 15, that are suspended from track 16 by a plurality of trolleys 18. Each sliding wall panel assembly 14 is generally constructed from a wall panel 20, an upper rail 22, and a lower rail 24. Wall panel 20 is constructed so that it forms a partition when suspended by track 16. Wall panel 20 may be constructed from any material suitable for providing a movable partition wall, such as glass, wood, metal, composites or any combination thereof. In a preferred embodiment, wall panel 20 is constructed from tempered glass so that it provides a transparent physical barrier.

Upper rail 22 and wall panel 20 are mechanically coupled so that wall panel 20 may be suspended from upper rail 22. Upper rail 22 includes a channel that receives an upper edge of wall panel 20. Upper rail 22 and wall panel 20 may be coupled by mechanical clamping, bonding or other fasteners that are sufficient to support the weight of wall panel 20 and any additional hardware mounted on wall panel 20, such as handles and or locks.

Similarly, lower rail 24 is mechanically coupled to wall panel 20 so that wall panel 20 and lower rail 24 may be suspended from track 16. Lower rail 24 includes a channel that receives a lower edge of wall panel 20 and lower rail 24 and wall panel 20 are coupled using mechanical clamping, bonding and/or fasteners. Upper and lower rails 22 and 24 may be constructed from any rigid material such as steel, aluminum and composite. Additionally upper and lower rails 22 and 24 may be provided in any desired finish. For example, the rails may be provided in a satin finish, dark bronze, stainless steel, etc.

Pivoting wall panel assembly 15 differs from wall panel assemblies 14 in that it includes an upper rail assembly that is constructed from pivot rail 26 and slide rail 28. Wall panel assembly 15 further includes pivot lock 11 which is coupled to pivot rail 26 and slide rail 28 and an optional retractable floor anchor 34 that is coupled to lower rail 29.

Pivot rail 26 includes a channel that receives an upper edge of wall panel 30. Pivot rail 26 and wall panel 30 may be coupled by mechanical clamping, bonding and/or fasteners similar to corresponding components of wall panel assemblies 14. As shown in FIG. 1, pivoting wall panel assembly 15 may be slid or rolled along track 16 when pivot lock mechanism 11 is in a sliding configuration and floor anchor 34 is retracted. In that sliding configuration, pivot rail 26 is coupled to slide rail 28 at two locations. Pivot rail 26 is coupled to slide rail 28 at a first location by pivot assembly 32 and at a second location by pivot lock 11.

Pivot assembly 32 is configured to allow pivot rail 26 to rotate relative to slide rail 28 about a vertical axis defined by a vertical axle 36 when pivot lock mechanism 11 is in a pivoting configuration. Axle 36 extends from an upper portion of pivot rail 26 into slide rail 28. Bearings 38 are interposed between axle 36 and pivot rail 26 so that pivot rail 26 rotates smoothly about axle 36. Axle 36 and bearings 38 are preferably selected so pivot assembly 32 alone may support the weight of wall panel assembly 15 when it is in the pivoting configuration.

Although in the present embodiment, pivot rail 26 is suspended vertically from slide rail 28, it should be appreciated that slide rail 28 and pivot rail 26 may be configured to have any desired relative position. For example, the pivot rail and slide rail may be hinged so that they are in a side-by-side relation. Additionally, it should be appreciated that the pivoting interface of the pivoting wall panel assembly may be constructed between a pivoting portion and a sliding portion that forms more than a mere rail. For example, the sliding portion may form a frame around the pivoting portion if desired.

Track 16 defines the path of sliding/rolling travel of wall panel assemblies 14 and pivoting wall panel assembly 15 of wall panel system 10. Track 16 is generally an elongate tubular member that includes a channel extending from the interior to the exterior of the tubular member. In the present embodiment, roller portion of each trolley 18 is configured to roll freely within the interior of track 16.

Each trolley 18 includes a vertical axle, such as a pendant bolt, that extends downward from the roller portion of trolley 18 and is coupled to either upper rail 22 of wall panel assembly 14 or slide rail 28 of pivoting wall panel assembly 15. The pendant bolt is configured to rotate relative to the remainder of trolley 18, thereby providing a rotating interface between wall panel assembly 14, or pivoting wall panel assembly 15, and trolley 18.

Pivot lock 11 provides coupled lock mechanisms for selectively coupling pivot rail 26 with slide rail 28 and slide rail 28 with track 16. In the sliding configuration of pivot lock mechanism 11, shown in FIG. 1, pivot lock 11 is configured to prevent relative rotation between pivot rail 26 and slide rail 28 and to allow relative translation between slide rail 28 and track 16. Conversely, in the pivoting configuration, shown in FIG. 2, pivot lock 11 is configured to allow relative rotation between pivot rail 26 and slide rail 28 and to prevent relative translation between slide rail 28 and track 16.

In the illustrated embodiment, wall panel system 10 employs a plurality of wall panel assemblies 14 and a single pivoting wall panel assembly 15, each of which is supported by two trolleys 18 engaged with track 16. Each wall panel assembly 14, 15 is separate from the others so that each may be separately translated along track 16 and stacked if desired.

Figure 4:
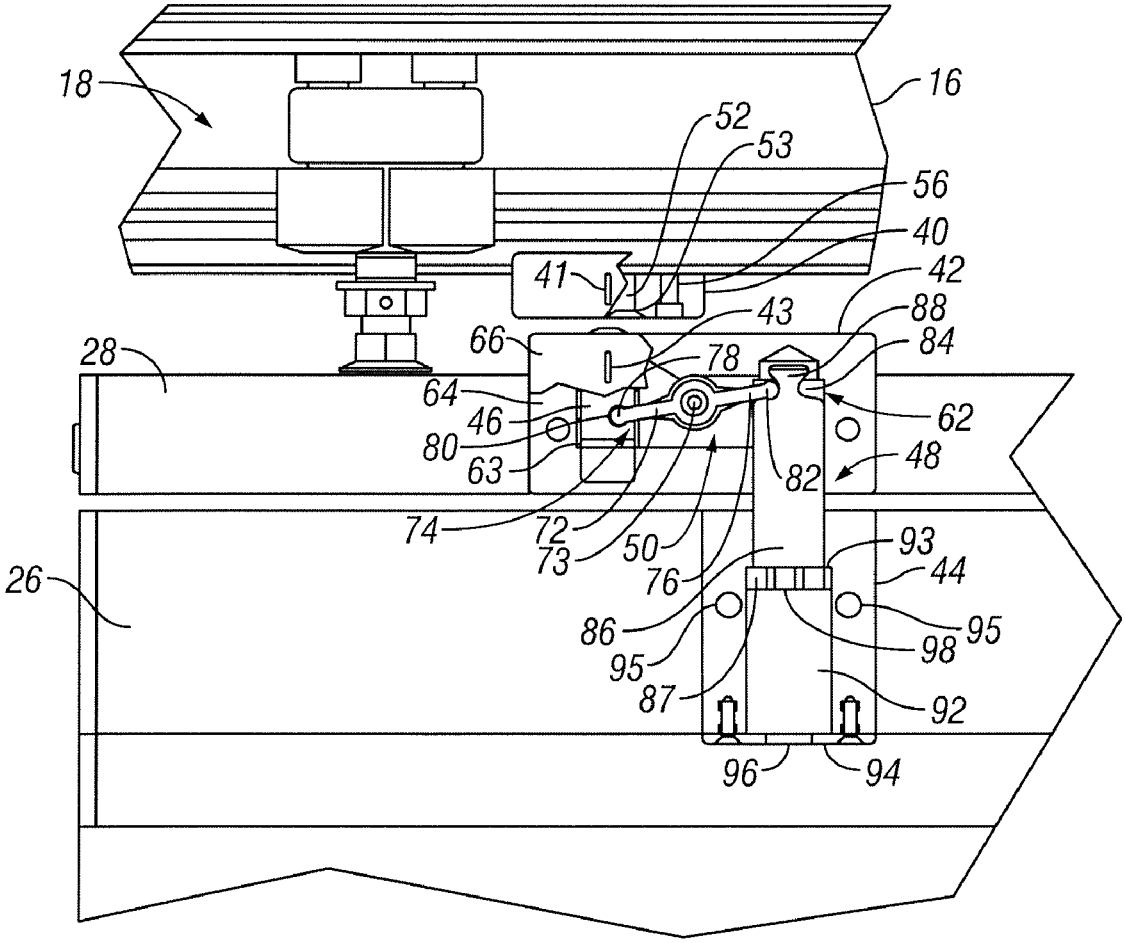
FIG. 4 is a partial cross-sectional side view of a portion of a wall panel assembly with the pivot lock mechanism in a sliding configuration.
Figure 5:
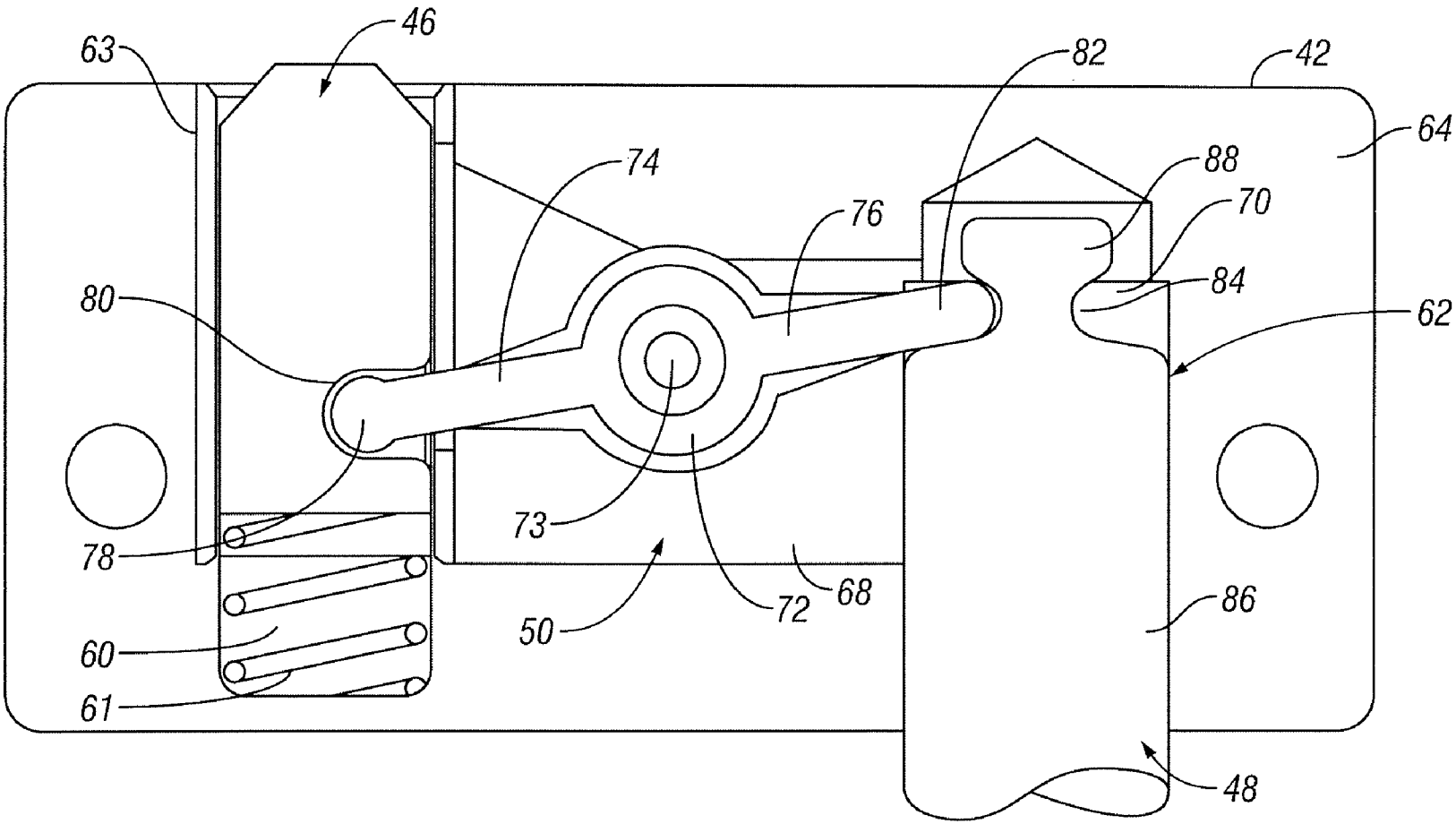
FIG. 5 is an enlarged cross-sectional side view of a portion of a pivot lock assembly in a sliding configuration.
Figure 6:
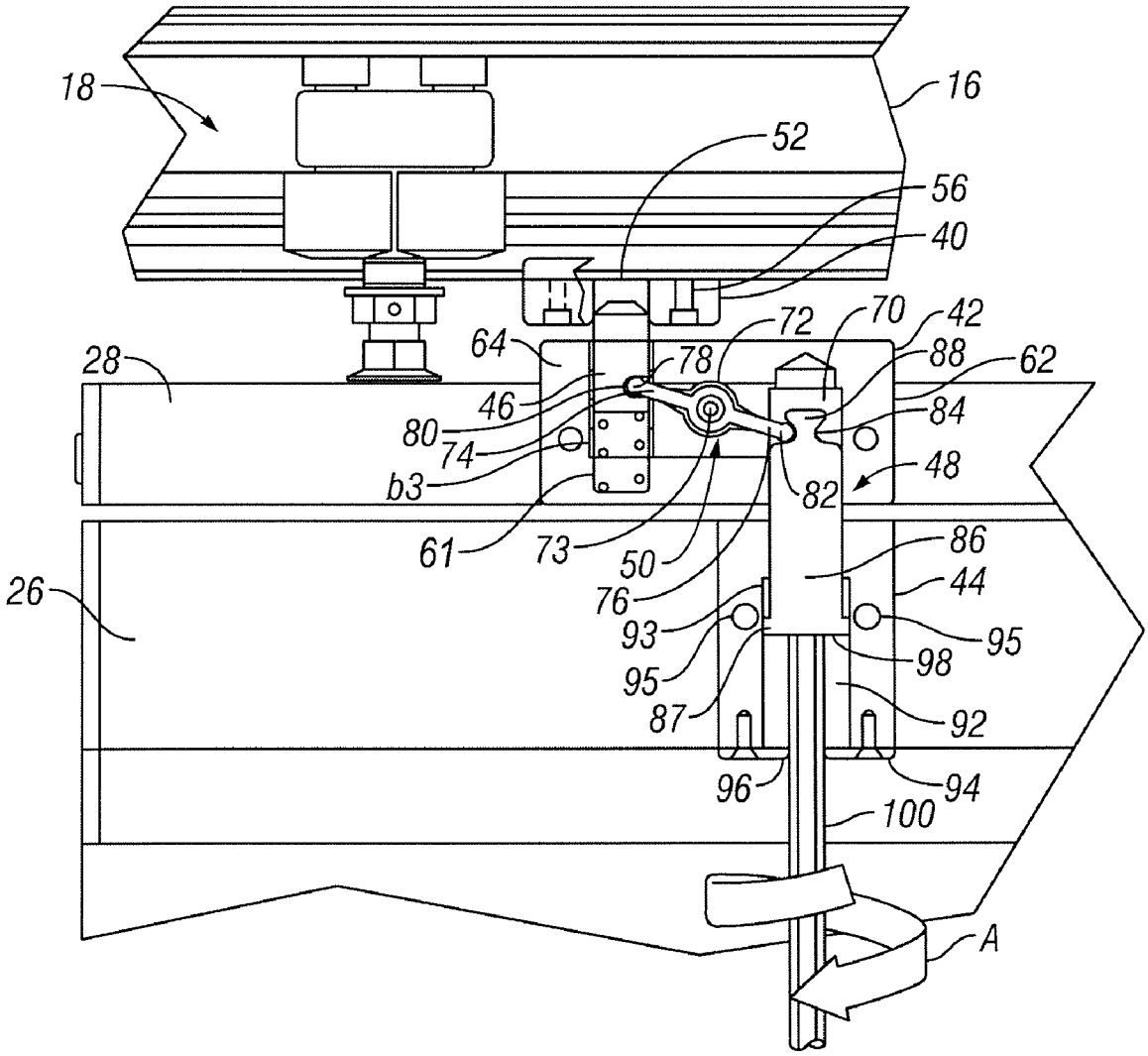
FIG. 6 is a cross-sectional side view of the portion of FIG. 4 with the pivot lock mechanism in a first intermediate configuration.

Referring to FIGS. 3-5, pivot lock mechanism 11, configured for sliding, will be described. Generally, pivot lock mechanism 11 includes track housing 40, slide housing 42, pivot housing 44, slide pin 46, pivot pin 48 and coupling mechanism 50. It should be appreciated, that the features of any or all of the track housing, slide housing and/or pivot housing may be incorporated into a respective track, sliding portion and/or pivoting portion of the wall panel assembly such that a separate housing component is not required.

Track housing 40 is coupled to track 16. The location of track housing 40 defines the position at which wall panel assembly 15 may be placed into a configuration for pivoting. Track housing 40 includes slide pin bore 52 that intersects a bottom surface of track housing 40 and is adapted to slidably receive an engagement portion of slide pin 46. The length of slide pin bore 52 is selected to receive a desired length of slide pin 46. Slide pin bore 52 may be a blind hole or a through hole, as desired. The opening of slide pin bore 52 at the bottom surface of track housing 40 may include a guide feature, such as chamfer 53, that is configured to guide slide pin 46 into slide pin bore 52 despite small misalignments.

In the present embodiment, track housing 40 includes a mounting shoulder 54 and mounting features 56, such as through holes. Shoulder 54 receives a lower corner portion of track 16 when track housing 40 is mounted to track 16. Preferably, fasteners extend through mounting features 56 and threadably engage corresponding threaded holes 57 included in track 16. It will be appreciated that slide pin bore 52 may alternatively be provided in track 16 rather than a separate track housing 40. It should also be appreciated that in embodiments utilizing a separate track housing 40, shoulder 54 need not be included. However, the inclusion of shoulder 54 simplifies installation of that component upon track 16. Although a single track housing 40 is illustrated in FIGS. 1 and 2, it should further be understood that a plurality of track housings 40 and/or slide pin apertures 52 integrated into track 16 may be included so that wall system 10 is provided with a plurality of locations at which wall panel assembly 15 may be converted into a pivoting configuration.

Slide housing 42 is coupled to slide rail 28 and encloses coupling mechanism 50 that converts motion of pivot pin 48 into motion of slide pin 46. Generally, slide housing 42 includes body portion 64 and cover 66. Slide pin bore 60 extends through a portion of body portion 64 and is sized to slidably receive at least a portion of slide pin 46. Additionally, a slide sleeve 63 may also be provided in body portion 64 and configured to define at least a portion of slide pin bore 60. Sleeve 63 may be any material that provides a desired coefficient of friction between slide pin 46 and sleeve 63. Sleeve 63 may be lubricated or self-lubricating if desired.

In the present embodiment, slide pin bore 60 is sized so that slide pin 46 may be fully retracted within slide pin bore 60 when pivot lock 11 is in a sliding configuration. Additionally, in the present embodiment, slide pin bore 60 is sized to house a biasing mechanism, such as biasing spring 61, that is configured to urge slide pin 46 into the extended position.

Alignment markings may be provided on track housing 40 and slide housing 42 so that when wall panel assembly 15 is in the sliding configuration it may be easily positioned in a correct location for conversion into the pivot configuration. In the present embodiment, track housing 40 includes alignment marking 41 that is disposed on an outer surface thereof so that it is easily visible by a user. Similarly, slide housing 42 includes alignment marking 43 that is disposed on an outer surface of slide housing 42 and positioned so that when slide pin 46 is aligned with slide pin bore 52, markings 41 and 43 are also aligned to provide a user with a visual indication of the alignment. Markings 41 and 43 may be any marking that provides the user with such a visual cue, such as machined channels, dots or printed indicia.

Slide housing 42 also includes pivot pin bore 62. Pivot pin bore 62 is sized to selectively receive an engagement portion of pivot pin 48. In the present embodiment, pivot pin bore 62 is spaced from and parallel to slide pin bore 60 and as a result the respective paths of travel of slide pin 46 and pivot pin 48 are parallel. However, it should be appreciated that the paths of travel need not be parallel. For example, in an embodiment in which the pivot rail and slide rail are in a side-by-side orientation and slide rail is vertically suspended from a track, the slide pin may be configured to reciprocate along a vertical axis while pivot pin is configured to reciprocate along a horizontal axis.

Pivot pin bore 62 preferably includes an engagement feature so that a portion of the weight of wall panel assembly 15 may be transmitted through pivot pin 48 and supported by slide rail 28. In the present embodiment, the engagement feature is a threaded inner surface 70 that is adapted to threadably engage a threaded outer surface of pivot pin 48. It should be appreciated, however, that any engagement features may be incorporated, but preferably the engagement feature is configured so that the weight of wall panel assembly 15 may be transmitted to the slide rail through the pivot pin. For example, a key and slot engagement feature may be incorporated that utilizes relative linear and rotational motion between pivot pin 48 and slide housing 42 to engage and disengage pivot pin 48 with slide housing 42.

Pivot pin 48 is adapted so that it may be selectively extended into or retracted from pivot pin bore 62 of slide housing 42. Pivot pin 48 includes circumferential groove 84 that is configured to interface with coupling mechanism 50 over a portion of the travel of pivot pin 48. Groove 84 is disposed at an interface of body portion 86 and head portion 88 of pivot pin 48. In the present embodiment, groove 84 extends around the full circumference of pivot pin 48 because full rotations of pivot pin 48 are required for threaded engagement between pivot pin 48 and slide housing 42. It will be appreciated however, that if less than full rotations are required between pivot pin 48 and slide housing 42, groove 84 need not extend around the full circumference of pivot pin 48.

The outer diameters of each of the portions of pivot pin 48 are selected so that pivot pin 48 is fully disengaged from coupling mechanism 50 when pivot pin 48 is fully retracted from slide housing 42. In particular, body portion 86 is constructed with an outer diameter that is greater than an outer diameter of head portion 88. Additionally, head portion 88 is constructed so that its outer diameter is greater than the diameter of circumferential groove 84. The difference in the diameters permits a portion of coupling mechanism 50 to be received in groove 84 during extension of pivot pin 48 into slide housing 42.

Coupling mechanism 50 is configured so that motion of pivot pin 48 causes concerted motion of slide pin 46. Coupling mechanism 50 is interposed between slide pin 46 and pivot pin 48 and is housed within a coupling mechanism cavity 68 of slide housing 42. Coupling mechanism 50 includes link 72 that is pivotally coupled at pivot location 73 to slide housing 42. Link 72 includes first arm 74 that extends from pivot 73 toward slide pin 46 and second arm 76 that extends from pivot location 73 toward pivot pin 48.

First arm 74 includes a generally cylindrical end portion 78 that engages slot 80, which extends radially into a portion of slide pin 46. The size of slot 80 is selected so that end portion 78 may be received in slot 80 and may rotate within slot 80 during motion of link 72 caused by extension and retraction of pivot pin 48. Additionally, the depth and width of slot 80 and the length and thickness of first arm 74 are selected so that a desired amount of linear translation of slide pin 46 may be achieved when link 72 is rotated.

Second arm 76 also includes a generally cylindrical end portion 82. End portion 82 is received in circumferential groove 84 of pivot pin 48 during a portion of the travel of pivot pin 48. The length of second arm 76 and the diameters of the head and body portions and groove 84 of pivot pin 48 are selected so that when pivot pin 48 is extended into slide housing 42 end portion 82 is received in circumferential groove 84 and remains in groove 84 as pivot pin 48 is further extended. During that further extension, end portion 82 is translated with pivot pin 48 and simultaneously rotated about pivot 73 within groove 84. Groove 84 may be tapered so that a desired amount of rotation of second arm 76 is permitted within groove 84.

In the present embodiment, first arm 74 is disposed 180 degrees away from second arm 76, i.e., first arm 74 and second arm 76 extend from pivot location 73 in opposite directions, so that link 72 is a generally straight elongate member. Additionally, the length of first arm 74 is approximately equal to the length of second arm 76. As a result, the paths of travel of slide pin 46 and pivot pin 48 are parallel and the length of linear travel of slide pin 46 is approximately equal to the length of linear travel of pivot pin 48 when it is engaged with link 72. However, it should be appreciated that the first and second arms may have any desired orientation and/or length.

A biasing mechanism, such as biasing spring 61, may be incorporated so that slide pin 46 and/or pivot pin 48 are urged toward a desired position. For example, in the present embodiment, biasing spring 61 is disposed within slide pin bore 60 of slide housing 42. Biasing spring 61 is positioned within slide pin bore 60 between a bottom surface of slide pin 46 and a bottom surface of bore 60 and is configured so that it is in compression. As a result, biasing spring 61 is configured so that slide pin 46 is biased to the extended position in which an upper portion of slide pin 46 is inserted into slide pin bore 52 of track housing 40. It should be appreciated that the biasing mechanism may be configured to act upon the slide pin, the link and/or the pivot pin as desired to urge the slide pin and/or the pivot pin into a desired position. For example, a torsional spring may be incorporated into link 72 to urge rotation of link 72 such that first arm 74 urges slide pin 46 toward the extended position.

Pivot pin 48 is extendable from pivot housing 44, which is fixedly coupled to a pivot rail 26 of wall panel assembly 15. Pivot housing 44 includes pivot pin bore 92 that extends through housing 44 and cover 94 that is removably coupled to housing 44 to retain pivot pin 48 within pivot pin bore 92.

Pivot housing 44 may be fixedly coupled to pivot rail 26 or integrally incorporated therein. In embodiments, wherein pivot housing 44 is a separate component coupled to pivot rail 26, it may be mechanically coupled by fasteners and/or bonding. In the present embodiment, pivot housing 44 includes through holes 95 configured to receive mechanical fasteners such as machine screws. Corresponding threaded holes are provided in pivot rail 26 to receive the fasteners.

Pivot pin bore 92 is stepped so that it includes a shoulder 93 and the diameter of pivot pin bore 92 decreases in the direction of slide housing 42. Shoulder 93 is located and sized so that it engages shoulder 87 of pivot pin 48 when pivot pin 48 is fully extended and engaged with slide housing 42. In particular, as pivot pin 48 is engaged in slide housing 42 and extended further into slide housing 42, shoulder 87 of pivot pin 48 is drawn toward shoulder 93 of pivot pin bore 92. Further extension of pivot pin 48 and engagement of shoulder 87 with shoulder 93 of pivot pin bore 92 draws pivot housing 44 toward slide housing 42 and results in a portion of the load of wall panel assembly 15 being transmitted from pivot rail 26 to slide rail 28 through pivot pin 48.

Cover 94 is removably coupled to pivot housing 44 by a plurality of removable fasteners, such as machine screws. Cover 94 is generally a plate that includes an aperture 96 that is aligned with pivot pin bore 92. Aperture 96 is provided so that a control interface, such as a tool engagement feature, included on pivot pin 48 may be directly engage with an engagement tool 100 by a user. In the present embodiment, pivot pin 48 includes a tool engagement feature, e.g., a hexagonally shaped aperture 98 that is sized to receive a hexagonally shaped wrench, such as an Allan wrench.

Although in the present embodiment, the single control interface is provided on pivot pin 48, it should be appreciated that the single control interface may interact with any of the moving components of pivot lock 11. For example, the single control interface may interact with pivot pin 48, slide pin 46 and/or link 72.

It should further be appreciated that an electromechanical actuator may be incorporated for operating pivot lock 11 and such an actuator may be operated electronically if desired. For example, in an embodiment, an electromechanical motor may be coupled to the link of the coupling mechanism and the motor may be triggered wirelessly with a remote control or a wall mounted switch.

Additionally, electronic position sensors may be incorporated that determine if the wall panel assembly is positioned for proper operation of the pivot lock mechanism. Those sensors may provide visual indications of alignment and/or electronic signals to a control system. Those electronic signals may be utilized to permit or prevent operation of an actuator so that the pivot lock mechanism may only be actuated after it is properly positioned.

Referring to FIGS. 4 and 6-8, operation of pivot lock 11 will be described. In FIG. 4, pivot lock 11 is configured so that wall panel assembly 15 is in a sliding configuration. In that configuration, pivot pin 48 is extended and threadably engaged with slide housing 42. In that position, pivot pin 48 extends between pivot housing 44 and slide housing 42 and prevents relative movement between pivot housing 44 and slide housing 42.

Slide pin 46 is fully retracted into slide housing 42 so that it is disengaged and separated from slide pin bore 52 of track housing 40. As a result, relative motion is permitted between track 16 and slide rail 28, thereby permitting wall panel assembly 15 to be translated along track 16. Also in that configuration, shoulder 87 of pivot pin 48 is in contact with shoulder 93 of pivot housing 44 so that a portion of the load of wall panel assembly 15 may be transmitted through pivot pin 48 to slide rail 28.

When a user desires to convert wall panel assembly 15 into a pivoting configuration, wall panel assembly 15 is translated to a position in which slide pin 46 is aligned with slide pin bore 52, as also shown in FIG. 4. Alignment markings 41 and 43 may be used to provide a user with visual indicia of proper positioning. Next, floor anchor 34 is converted into a pivoting configuration in which spindle 35 is extended downward and into a feature included in the floor below wall panel assembly 15. It is preferred that the floor anchor 34 be converted into the pivoting configuration prior to release of the spindle 35, in order to avoid downward movement of the panel upon release of the spindle 35, which potentially could damage the free bottom corner or edge of the panel. After floor anchor 34 is converted into the pivoting configuration, then the pivot pin 48 may be released, such as by insertion of control tool 100 through aperture 96 of cover 94 and engages tool 100 with the tool engagement feature, hexagonal aperture 98, of pivot pin 48. After the tool is engaged, the user uses tool 100 to rotate pivot pin 48 in the direction required to unthread pivot pin 48 from pivot pin bore 62 of slide housing 42, as shown by arrow A.

As pivot pin 48 is retracted, link 72 is permitted to rotate about pivot 73. Furthermore, in the present embodiment, groove 84 and second arm 76 are sized so that for a portion of the travel of pivot pin 48 second arm 76 is forced to translate with pivot pin 48 because it is trapped within groove 84 by head portion 88. As link 72 rotates, slide pin 46 is extended by rotation of link 72 and the force exerted on slide pin 46 by biasing spring 61.

Further retraction of pivot pin 48 results in further rotation of link 72 both due to force directly applied to link 72 by pivot pin 48 and indirectly applied to link 72 by biasing spring 61 through slide pin 46.

Figure 7:
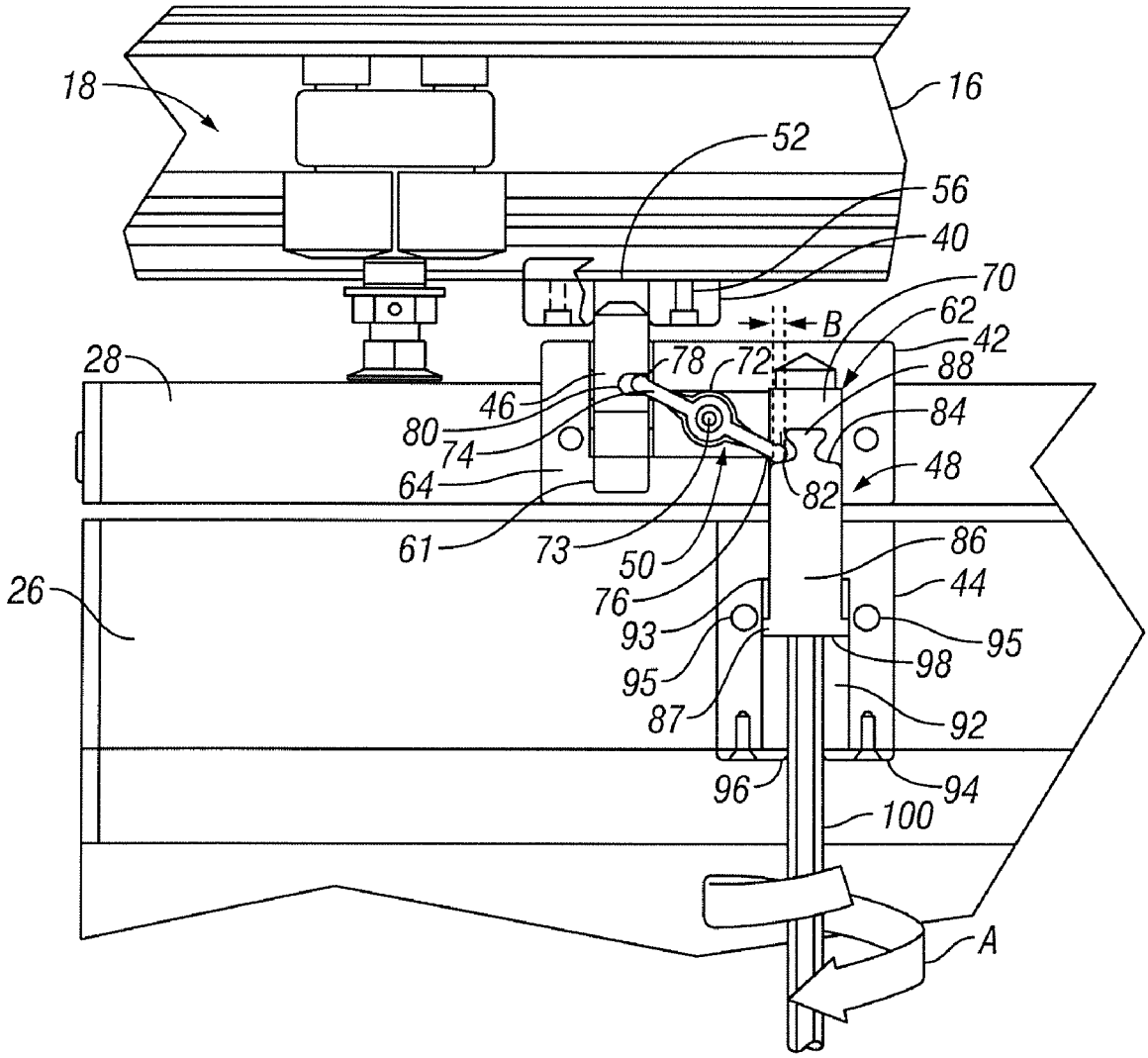
FIG. 7 is a cross-sectional side view of the portion of FIG. 4 with the pivot lock mechanism in a second intermediate configuration.

As link 72 rotates, the cylindrical end 82 of second arm 76 travels along an arcuate path. Because of that path and the selected diameter of head portion 88 of pivot pin 48, when slide pin 46 approaches its extended position, clearance B is provided between head portion 88 of pivot pin 48 and cylindrical end 82 of second arm 76, as shown in FIG. 7. That clearance allows pivot pin 48 to fully disengage from link 72 and to be fully separated from slide housing 42.

Figure 8:
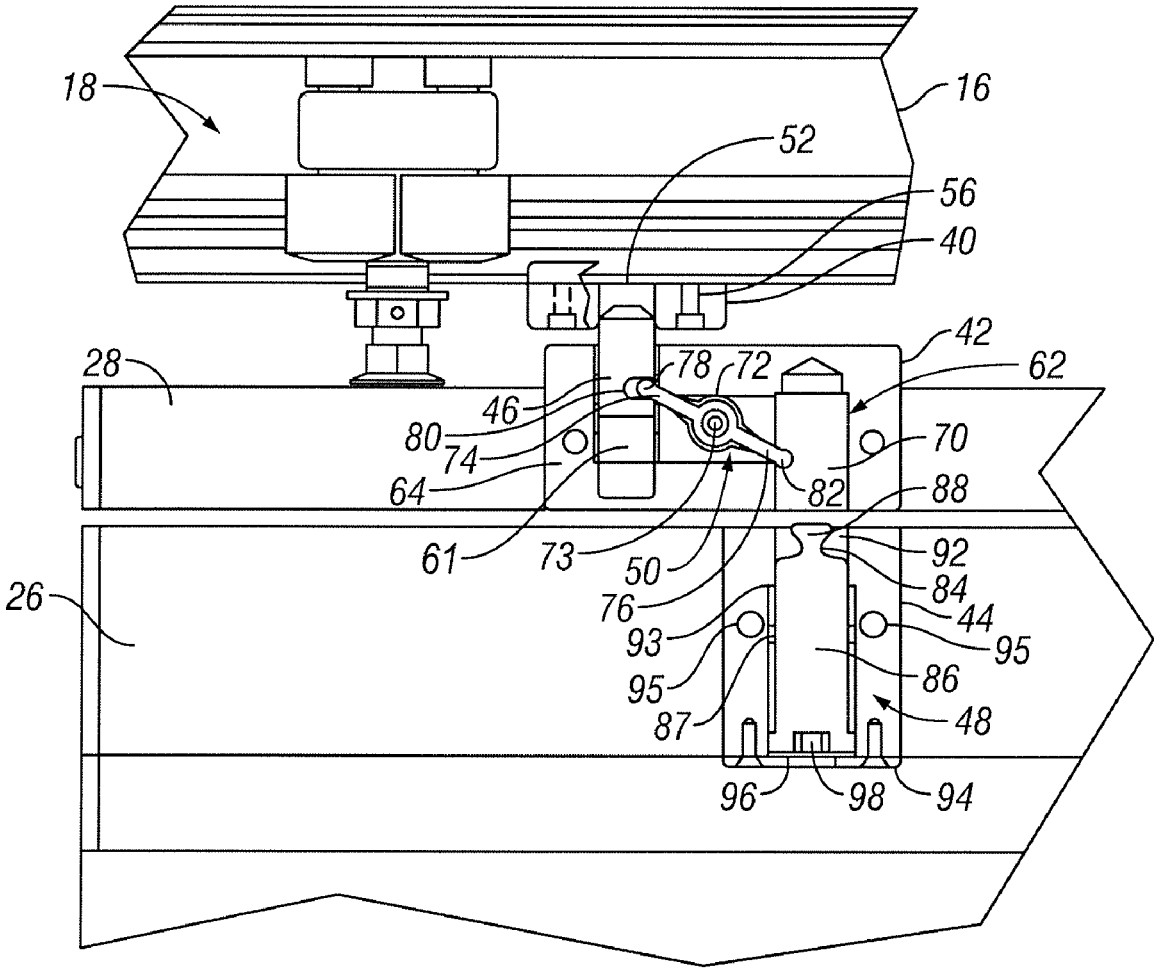
FIG. 8 is across-sectional side view of the portion of FIG. 4 with the pivot lock mechanism in a pivoting configuration.

As shown in FIG. 8, when pivot pin 48 is fully retracted, slide pin 46 is fully extended, thereby placing pivot lock 11 into a pivoting configuration. In particular, slide pin 46 extends between track housing 40 and slide housing 42 so that a portion of slide pin 46 engages slide pin bore 52. In that position, slide pin 46 prevents relative translation between track 16 and slide rail 28.

At the same time, pivot pin 48 is full disengaged from pivot pin bore 62 of slide housing 42. As a result, pivot rail 26 is permitted to rotate relative to slide rail 28 about pivot assembly 32. In the fully retracted position, pivot pin 48 is retained within pivot housing 44 by cover 94. After pivot pin 48 is fully retracted, the user preferably removes tool 100.

Thus, it is seen that a pivot lock and method of use are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A pivot lock mechanism for a wall panel system including a pivoting wall panel including a sliding portion that is translatable along a track and a pivoting portion that pivots relative to the sliding portion, comprising:

a first lock member movable between an extended position in which the first lock member extends between the sliding portion and the track and prevents relative motion therebetween, and a retracted position in which the first lock member is positioned such that relative motion is permitted between the sliding portion and the track;

a second lock member movable between an extended position in which the second lock member extends between the sliding portion and the pivoting portion and prevents relative motion therebetween, and a retracted position in which the second lock member is positioned such that relative motion is permitted between the sliding portion and the pivoting portion; and a coupling mechanism extending between the first and second lock members that couples the first and second lock members such that when the first lock member is in the extended position the second lock member is in the retracted position, and when the first lock member is in the retracted position the second lock member is in the extended position.

2. The pivot lock mechanism of claim 1, wherein the first and second lock members are engagement pins.

3. The pivot lock mechanism of claim 2, further comprising:

a first housing adapted to be coupled to the sliding portion and including a first bore and a second bore; and a second housing adapted to be coupled to the pivoting portion and including a third bore;

wherein at least a portion of the first lock member is disposed in the first bore, and wherein at least a portion of the second lock member is disposed in the third bore, and a portion of the second lock member is received by the second bore when the second lock member is in the extended position.

4. The pivot lock mechanism of claim 3, further comprising a third housing adapted to be coupled to the track and including a fourth bore, wherein a portion of the first lock member is received in the fourth bore when the first lock member is in the extended position.

5. The pivot lock mechanism of claim 3, wherein the second bore includes a threaded inner surface and the second lock member includes a threaded outer surface that engages the threaded inner surface of the second bore when the second lock member is in the extended position.

6. The pivot lock mechanism of claim 3, wherein the coupling mechanism includes a link that is pivotally coupled to the first housing at a pivot and the link includes a first arm extending from the pivot to the first lock member and a second arm extending from the pivot to the second lock member.

7. The pivot lock mechanism of claim 6, wherein the first arm and second arm are disposed approximately 180 degrees from each other about the pivot.

8. The pivot lock mechanism of claim 6, wherein the first arm has a length that is approximately equal to a length of the second arm.

9. The pivot lock mechanism of claim 6, wherein the second lock member includes a circumferential channel and a portion of the second arm is received in the channel over a portion of the travel of the second lock member.

10. The pivot lock mechanism of claim 1, further comprising a biasing mechanism that is adapted to force the first lock member into the extended position.

11. A wall panel system, comprising:

a track; and a wall panel assembly including a sliding portion slidably coupled to the track, a pivoting portion pivotally coupled to the sliding portion, and a pivot lock, wherein the pivot lock includes a first lock member, a second lock member and a coupling mechanism extending between the first and second lock members, wherein the first lock member is movable between an extended position in which the first lock member extends between the sliding portion and the track and prevents relative motion therebetween, and a retracted position in which the first lock member is positioned such that relative motion is permitted between the sliding portion and the track, wherein the second lock member is movable between an extended position in which the second lock member extends between the sliding portion and the pivoting portion and prevents relative motion therebetween, and a retracted position in which the second lock member is positioned such that relative motion is permitted between the sliding portion and the pivoting portion, and wherein the coupling mechanism couples the first and second lock members such that when the first lock member is in the extended position the second lock member is in the retracted position, and when the first lock member is in the retracted position the second lock member is in the extended position.

12. The wall panel system of claim 11, wherein the first and second lock members are engagement pins.

13. The wall panel system of claim 12, further comprising:

a first housing coupled to the sliding portion and including a first bore and a second bore; and a second housing coupled to the pivoting portion and including a third bore;

wherein at least a portion of the first lock member is disposed in the first bore, and wherein at least a portion of the second lock member is disposed in the third bore, and a portion of the second lock member is received by the second bore when the second lock member is in the extended position.

14. The wall panel system of claim 13, further comprising a third housing coupled to the track and including a fourth bore, wherein a portion of the first lock member is received in the fourth bore when the first lock member is in the extended position.

15. The wall panel system of claim 13, wherein the second bore includes a threaded inner surface and the second lock member includes a threaded outer surface that engages the threaded inner surface of the second bore when the second lock member is in the extended position.

16. The wall panel system of claim 13, wherein the coupling mechanism includes a link that is pivotally coupled to the first housing at a pivot and the link includes a first arm extending from the pivot to the first lock member and a second arm extending from the pivot to the second lock member.

17. The wall panel system of claim 16, wherein the first arm has a length that is approximately equal to a length of the second arm.

18. The wall panel system of claim 16, wherein the second lock member includes a circumferential channel and a portion of the second arm is received in the channel over a portion of the travel of the second lock member.

19. The wall panel system of claim 11, further comprising a biasing mechanism that is adapted to force the first lock member into the extended position.

20. The wall panel system of claim 11, further comprising a retractable floor anchor.

* * * * *